United States Patent [19]

Phillips

[11] 4,044,530

[45] Aug. 30, 1977

[54] APPARATUS FOR GUIDING AND CUSHIONING A PLURALITY OF ARTICLES AS THEY MOVE INTO A CONTAINER

[75] Inventor: David E. Phillips, Forest, Va.

[73] Assignee: Simplimatic Engineering Co., Lynchburg, Va.

[21] Appl. No.: 543,069

[22] Filed: Jan. 22, 1975

[51] Int. Cl.[2] ..... B65B 5/08

[52] U.S. Cl. ..... 53/248; 53/262

[58] Field of Search ..... 53/248, 262

[56] References Cited

U.S. PATENT DOCUMENTS

| | | | |
|---|---|---|---|
| 3,104,609 | 9/1963 | Crawford | 53/262 X |
| 3,788,034 | 1/1974 | Hartness | 53/248 |
| 3,911,647 | 10/1975 | Hartness | 53/248 |

*Primary Examiner*—Leon Gilden

*Attorney, Agent, or Firm*—James & Franklin

[57] ABSTRACT

An apparatus for guiding and cushioning a plurality of articles deposited into a container positioned beneath it. It is comprised of a rigid framework of spaced, elongated members having guides positioned at intervals along the members. The guides are tapered upward and extend outward on either side of the elongated members to define passages through which the articles pass, which passages are bounded by members on two sides and by the extended guide portions on the other sides. Flexible fingers extending downwardly and toward the center of each passage have mounting portions fastened to the elongated members by the tapered guides; preferably two fingers extend into different passages from a common mounting portion. The tapered guides align each article with a passage where the flexible fingers cushion and precisely position the article as it moves into the container. Each mounting portion can be resiliently fastened in place to provide adjustability of the cushioning effect by adjusting the resiliency.

45 Claims, 7 Drawing Figures

FIG. 1
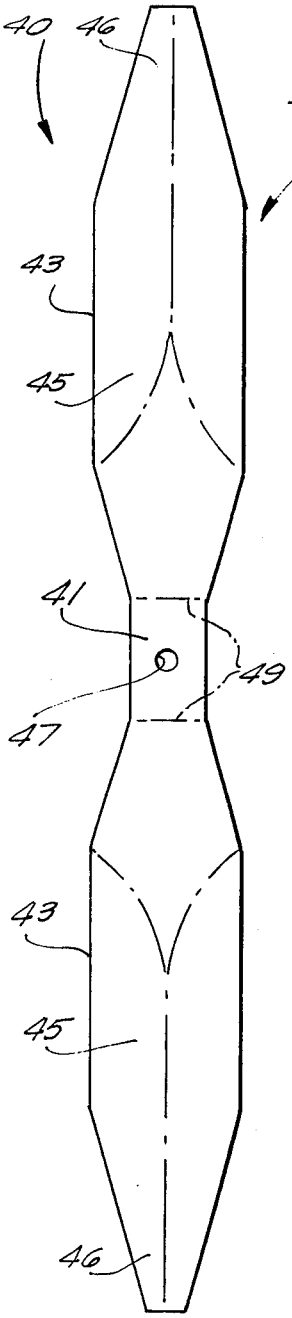
FIG. 3
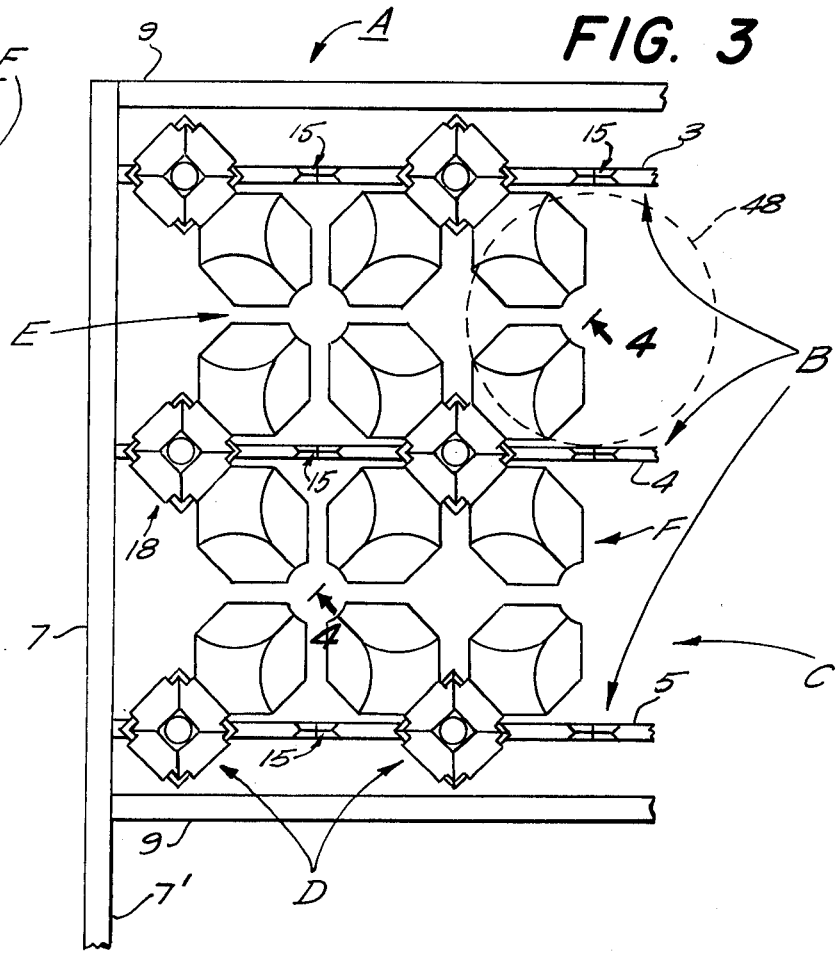
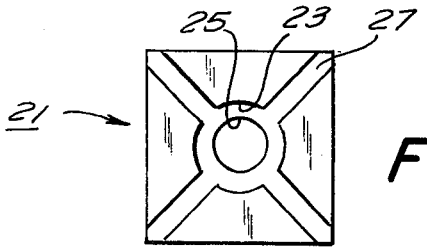
FIG. 5
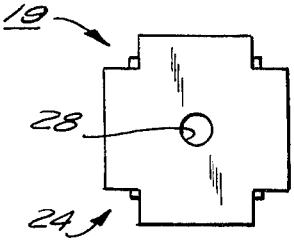
FIG. 6

APPARATUS FOR GUIDING AND CUSHIONING A PLURALITY OF ARTICLES AS THEY MOVE INTO A CONTAINER

The present invention relates to an apparatus for guilding and cushioning a plurality of articles as they move into a container which may be divided into cells. It is well known to use a packing grid for placing fragile articles, such as bottles, into a container such as a packing carton or wooden crate. Each grid has a plurality of passages provided with downwardly extending flexible fingers. As each bottle passes through a grid passage toward the container it spreads apart the flexible fingers which thereby guide it into the appointed position in the container and cushion the impact.

Though various grid constructions have been devised all have had some deficiency affecting their durability, performance, ease of assembly and repair, or cost. Some of the prior art grids are made of criss-crossing bars forming square passages. Flexible fingers are attached to the bars at the four sides of each passage. This arrangment is inefficient since the fingers, in their spread position, and the means required for attaching the fingers to the bars occupy a portion of the passage resulting in a waste of container space because that area of the container below the spread fingers and the attachment means must remain empty. Also, because the flexible fingers require a solid member to which they can be attached, four bars must be used to form the sides of every passage. This adds to the weight, expense and maintenance cost of each grid. Weight is an important factor because the grids are manually lifted and secured to the packing machine. As a solution to the inefficient usage of container space, grids were devised having the flexible fingers fastened to the corners of each passage. This permits more efficient utilization of container space when round bottles are being packed since the flexible fingers move into a corner and out of the way as the bottles do not extend into the corners. A closer packing of the bottles and a reduction of the amount of empty, wasted container space is thus made possible. However, it is more difficult to attach a finger to a corner than to a side bar and extra parts are required to make the attachment feasible. Furthermore, previous arrangements are unsatisfactory since the fingers are attached individually to the grid with several fastening means being required to provide a secure attachment, thereby increasing the number of parts used. The use of criss-crossing bars and the arrangements for attaching fingers to passage corners of prior grids both combine to make assembly and replacement difficult, time consuming, and costly.

Though most of the previously devised grids do an adequate job in having the flexible fingers guide and cushion the bottles once inside the grid, bottle breakage too often occurs when the bottles are misaligned and hit the bars instead of entering cleanly into the passage. To prevent such breakage curved metal guides are placed above the bars to nudge the bottles into the passages without breakage. However, these guides are positioned on the bars at the sides of the passages, thereby occupying a portion of the passage and creating wasted space in the container since that area of the container below the guides must remain empty. Furthermore, the guides are individually fastened four to a passage. A large number of parts is thus required to individually fasten the guides, as well as the fingers, to be bars resulting in increased assembly time, cost and weight.

Packing grids are used in packing many different types of articles of various weights and sizes. With prior art grids different fingers must be used for articles of similar size but of different weight because more of a cushioning effect is required for heavier articles to prevent breakage upon impact. The only way to vary the cushioning effect is either to change from one grid having one type of fingers to another grid having fingers with the required cushioning effect or to use the same grid but replace all of its fingers. In the former case a large number of grids must be kept on hand while in the latter case more fingers are needed and much time and labor must be expended on their replacement.

All the major parts of previous packing grids have been made of metal because of its resistance to wear. However, when relatively fragile articles like glass bottles are being packed the unyielding metal may cause breakage when struck by the descending bottles. Also, metal parts are relatively heavy. Furthermore, such contact creates quite a high level of noise when many bottles are being packed simultaneously.

It is a general object of the present invention to provide an apparatus for guiding and cushioning articles deposited into a container which is durable, effective, lightweight and inexpensive.

It is another object of the present invention to reduce the incidence of breakage of articles deposited into a container.

It is yet another object of the present invention to provide an apparatus for guiding and cushioning articles deposited into a container which requires a reduced number of parts.

It is a further object of the present invention to provide an apparatus for guiding and cushioning articles deposited into a container with easily installable and replaceable parts.

A still further object of the present invention is to provide an apparatus for guiding and cushioning articles deposited into a container with the capability of adjusting the cushioning effect.

Yet another object of the present invention is to reduce the noise produced as articles pass through an apparatus for guiding and cushioning them into a container.

The apparatus of the present invention comprises spaced bars secured together at the ends to form a rigid framework. Tapered guide elements are spaced at intervals along the bars and extend out on either side of the bars. These guide extensions combine with the bars to define rows of passages, through which passages the articles pass into the container. Each passage is bounded by bars on two sides and by the guide extensions on the other sides. Flexible fingers extending downward and toward the center of each passage have a mounting portion fastened between the guides and the bars at the corners of each passage. A plurality of such fingers extend from the same mounting portion into different passages. Only one fastening means is needed to fasten the finger mounting portions between the guides and the bars at each position along the bars. To provide an adjustable cushioning effect the fingers are resiliently fastened between the guides and bars. As the resiliency is adjusted so is the cushioning effect exerted by the fingers.

To the accomplishment of the above, and to such other objects as may hereinafter appear, the present invention relates to the construction of an apparatus for guiding and cushioning articles deposited into a container wherein a small number of relatively inexpensive, easily installable, lightweight, durable and breakage-reducing parts are used, as defined in the appended claims and as described in this specification, taken together with the accompanying drawings, in which:

FIG. 1 is a top view of a pair of flexible fingers constructed of one straight piece before they are bent into their proper position;

FIG. 3 is a top plan view of one end of the packing framework assembly;

FIG. 5 is a bottom plan view of one piece of the tapered guide;

FIG. 6 is a bottom plan view of another piece of the tapered guide;

Figure 2:
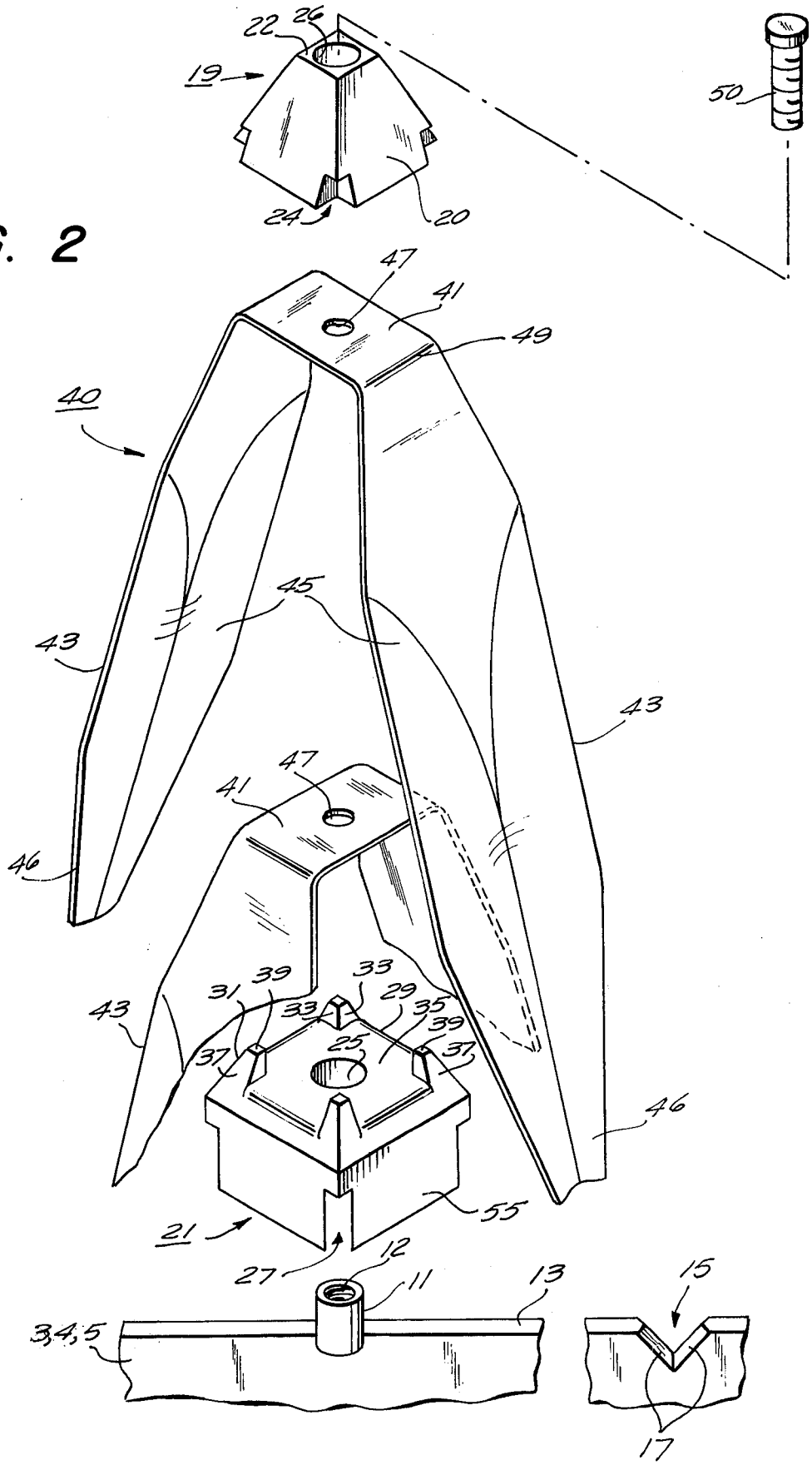
FIG. 2 is an exploded perspective view of the fingers and guides aligned for attachment to the bars.

The present invention is an apparatus used in conjunction with a machine for depositing articles into a container, which machine often performs some other desired operation on the articles. A bottling machine will be referred to in the description of the embodiments merely for the purpose of providing an example but other machines involving a variety of articles are equally applicable. When the bottles are ready to be packed the machine conveys them to a packing station and positions them in several rows. The present invention, which is directed to modifications of an apparatus that has become conventionally known, and will hereafter be referred to, as a packing grid, is secured to the bottling machine directly below these rows. A packing container with or without cells, depending on the application, is either brought up to the machine or the packing station is brought down toward the container and when the two are close enough to each other the bottles are released to fall into the container. Up to this point the equipment is conventional and since details of the bottling machine, means to fasten the grid to the machine, and the means to bring the container and machine toward each other form no part of the invention, any further detailed discussion of these elements is deemed unnecessary.

A conventional packing grid basically consists of bars, flexible fingers, and guides as well as means for attaching these parts to each other. In order to simplify the structure of packing grids to provide a cheaper, lighter, and more easily serviceable apparatus some of these conventionally used parts must be reduced in number. Four flexible fingers and four guides must be used for each passage if the articles are to be properly positioned from all directions. As far as the bars are concerned, it was formerly thought that criss-crossing bars are essential to (1) provide a strong, rigid framework, (2) support the flexible fingers, (3) support the guides, and (4) define the passages. I have discovered, however, that all of the above functions can be provided even though a significant number of bars are eliminated. As to the first function, a framework with the necessary strength and rigidity can be built by fastening the ends of several spaced, elongated bars to a strong, rigid support, thus eliminating the need for cross bars. As to the second and third functions, only two spaced bars are absolutely essential for each passage to support corner mounted fingers and guides since the two bars form a part of all four corners, whereas with the previous side-mounted fingers and guides criss-cross bars were required. A support assembly mounted to these two bars is provided to securely support and maintain the fingers and guides in position. Finally, while some metal bars are clearly essential to provide rigidity and to support the fingers and guides, other parts, lighter and cheaper than metal, are used to define that portion of each passage formerly defined by the now eliminated cross-bars. Thus, a reduction in the number of bars is made possible without compromising the structural and operational integrity of the apparatus. As to the number of attachment means used, previous grids required many of these since the fingers and guides were attached to the bars individually. The number of attachment means is significantly reduced in the present invention by constructing a plurality of fingers and guides so as to enable their attachment to the bars with only a single attachment means.

To broadly describe the invention in accordance with the goal of a durable and effective structure requiring less, and more easily installable, parts, a framework A is comprised of several spaced bars B defining unobstructed spaces C. Guides D are mounted on and spaced along bars B and have portions protruding above spaces C. Each space C contains a row of passages E with each passage being defined by only two bars B, at the sides, and four guides D, at the corners. The protruding portions of guides D define those sides of passage E where bars have been omitted. Flexible fingers F have a mounting portion from which a plurality of fingers extend. These mounting portions are fastened between bars B and guides D. Only a single fastening means is required to simultaneously fasten four fingers and four guides to bars B.

Turning now to a more particular description of the drawings, bars B are shown in FIG. 3 to comprise three elongated bars 3–5 secured at each end to a bar 7. Bar 7 in turn is secured to bars 9 which are substantially as long as bars 3–5. Although only one end of framework A is shown, its other end is identical to the one shown. Portion 7′ of bar 7 is secured by conventional means (not shown) to the packing station of a bottling machine (not shown).

Bars 3–5 are secured apart from each other to form rectangular spaces C extending unobstructed substantially the entire length of framework A. Each space C is bounded on the entire length of framework A. Each space C is bounded on its sides by bars 3 and 4 or by bars 4 and 5 and on its ends by bars 7. The width of space C is determined by the size of the bottles to be packed. Although only two spaces C are shown, this is merely exemplary and any number can be used to fit a particular application.

Since the framework must be manually lifted and attached to the packing station, its weight is an important factor and must be kept to a minimum. Consequently, bars 7 and 9, upon which the strength and rigidity of framework A largely depend, preferably are made of a strong, rigid yet relatively light material such as aluminum. Bars 3–5 need not be completely rigid since bars 7 and 9 provide the necessary framework rigidity. Consequently, bars 3–5 are made thinner than bars 7 and 9 in part to reduce weight, in part to waste a minimum of container space and in part to use as little material as possible in order to keep costs down. Since bars 3–5 form two sides of the passages E, the bottles can hit these bars on their way into the container. A wear resistant material, such as steel, is therefore preferable for bars 3–5.

The length of framework A is a matter of choice based on the size of packing container and the number bottles to be packed. Bars 7 and 9 are effective in providing a rigid framework A up to a certain length and no cross-bars are needed. Beyond this certain length, however, the required rigidity is difficult to maintain without such cross-bars. Though as many cross-bars as desired can be used, this number should be kept low to minimize the weight and cost of the framework. A maximum of one such cross-bar is sufficient for most purposes. Since such cross-bars form no part of the invention further details are deemed unnecessary.

Bars 3–5 are elongated, relatively thin, flat and straight. Though a certain amount of bending of the narrow bars is possible their width is such as to firmly support any object mounted on top of bars 3–5, as viewed in FIGS. 2 and 4, and no significant vertical movement is possible. Small cylindrical bosses 11 protrude from top edge 13 of bars 3–5. Bosses 11 can be attached to bars 3–5 in any one of several ways, such as by machining or welding. For the latter, which is prefrred because of its relatively low cost, a strong attachment is provided by first inserting one of bars 3–5 into a groove in a boss 11 and then welding the two together. Bosses 11 are placed at intervals along the length of bars 3–5 . Since these bosses are designed to support guides D which define part of the passage E as discussed in detail below, these intervals, along with the width of spaces C, determine the size of the passages E. For round bottles this interval distance corresponds substantially to the width of spaces C. Each of bosses 11 has a threaded hole 12 at its upper end to receive the fastening means, as discussed below.

Notches 15 are formed in the upper edges of bars 3–5 midway between bosses 11. These notches aid in aligning the bottles with passages E. As a bottle hits a side 17 of notch 15 it slides down the side 17 toward the center of notch 15 which is aligned with the center of passage E. Sides 17 are rounded to reduce the incidence of bottle breakage; a rounded edge is much less likely to cause bottle breakage than a sharp edge as it is struck by a bottle descending into the container.

Figure 4:
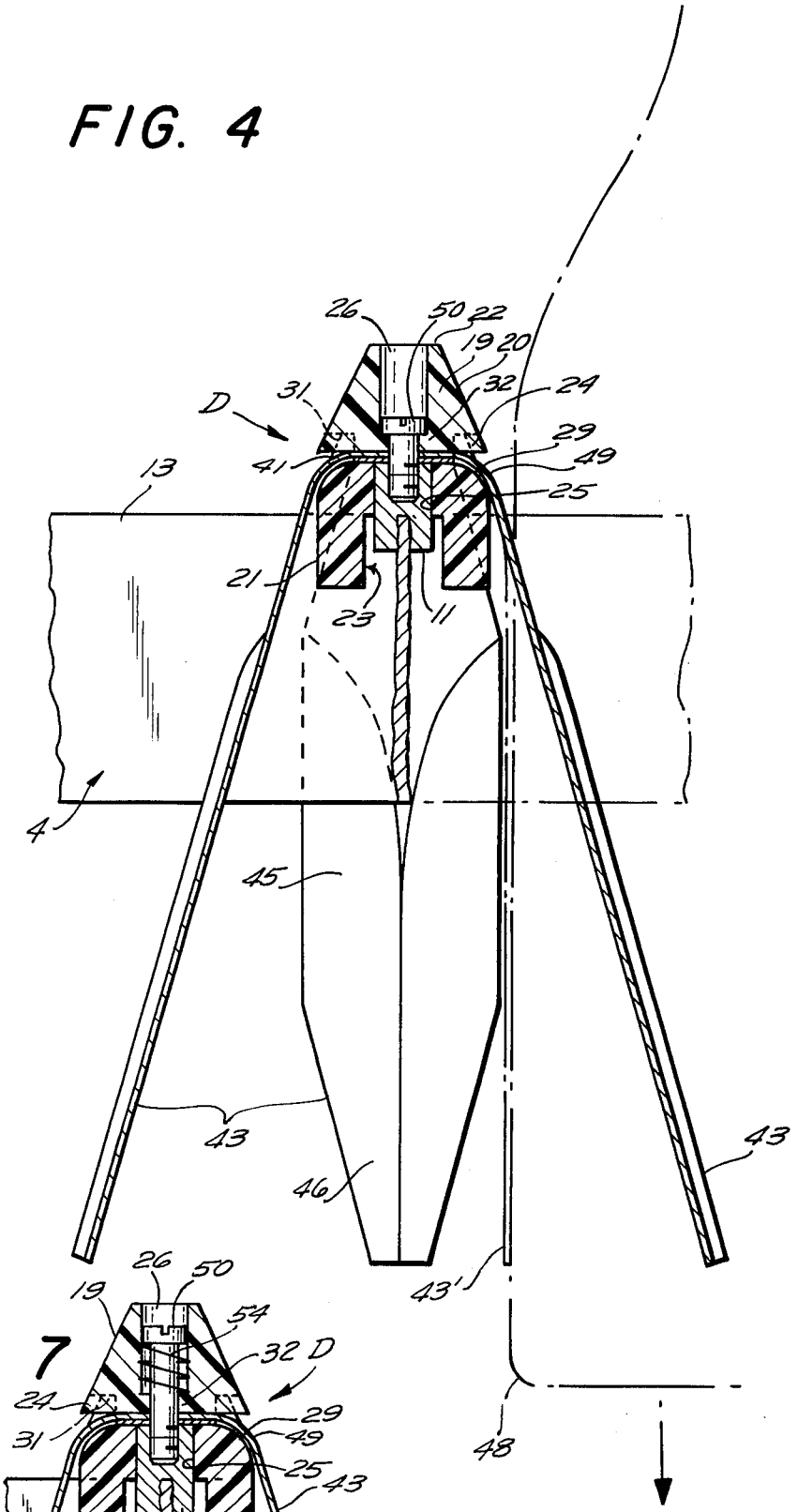
FIG. 4 is a sectional view taken along line 4—4 in FIG. 3.

Guide D is shown in FIGS. 2 and 4 as comprised of a top piece 19 and a bottom piece 21. The bottom piece 21 is designed to fulfill several requirements. First, guides D must be rigidly secured at particular positions to bars 3–5. Second, those sides of passages E not defined by bars B must be formed in and/or over unobstructed spaces C so that each bottle is placed at a particular position in the container. Third, since it is difficult to mount the fingers and guides on the narrow top edge of bars 3–5, bottom piece 21 must serve as a convenient, easily mountable support for fingers F and top piece 19.

Taking each of the above mentioned functions of bottom piece 21 in turn, it is first designed to be securely mounted on bars 3–5. As best shown in FIGS. 4 and 5, bottom piece 21 is substantially square and has a hole 23 in its lower portion. Hole 23 is made wide enough to accommodate boss 11 and any irregularities at the juncture of boss 11 and bars 3–5 formed by the weld. A smaller hole 25 extends from hole 23 to the top of piece 21. Hole 25 is made so as to fit snugly around substantially the entire length of boss 11. Grooves 27 run from hole 23 to each corner of piece 21 and have a height substantially equal to that of hole 23. Grooves 27 are made wide enough to accommodate the tops of bars 3–5. As bottom piece 21 is mounted on bars 3–5 boss 11 first enters hole 23. When it passes through hole 23 it enters hole 25 as the upper edge 13 of bars 3–5 simultaneously enters a set of aligned grooves 27. When piece 21 is properly seated, edge 13 engages the top of groove 27. In this arrangement insertion of bars 3–5 in groove 27 prevents piece 21 from turning or tilting during usage and keeps it aligned in the desired position. Boss 11 acts to keep piece 21 from sliding along bars 3–5 and its snug fit within hole 25 prevents piece 21 from wobbling. Although only one set of grooves 27 is needed in most cases, two sets of aligned grooves 27 are provided to accommodiate cross-bars in case the framework is long enough to require the use of cross-bars for added rigidity. Such cross-bars then fit into the perpendicular set of grooves 27. Though, as mentioned above, for most purposes no cross-bars or only one cross-bar are necessary, it is cheaper to make all the pieces 21 identical rather than to manufacture two types of bottom pieces.

To form passages F within spaces C, which is the second of the above-mentioned functions of piece 21, bottom pieces 21 are wide enough to extend substantially over spaces C. When mounted on bars 3–5, those pieces 21 facing each other from adjacent bars 3, 4 or 4, 5 are separated by a distance smaller than the size of the bottles being packed. Consequently, the bottles can only fit in passages bounded by bars 3, 4 or 4, 5 on two sides and a piece 21 at each corner. Due to the diagonal nature of grooves 27, opposite corners of piece 21 fit directly over bars 3–5 while the other two corners extend over spaces C. Thus, each corner of passage F is formed by the straight, smooth side 55 of piece 21 while the distance between facing pieces 21 is minimized to form a more clearly defined passage, by using the longest dimension of piece 21, the diagonal, to extend over spaces C.

To support flexible fingers F and top piece 19, third of the above mentioned functions of piece 21, the bottom piece 21 is provided with a flat upper surface 35 having rounded edges 29. A protrusion 31 extends upward from bottom piece 21 at each corner of surface 35. Protrusion 31 has two sides 33 adjacent surface 35 and two sides 37 facing away from surface 35. Sides 33 are perpendicular to surface 35 while sides 37 are at an acute angle to surface 35. This angle is necessary to prevent part of protrusion 31 from jutting out beyond top piece 19, as discussed below. The top edge 39 of protrusion 31 is flat. The mounting portion of flexible fingers F is designed to lie on top of surface 35 and fit snugly between adjacent protrusions 31 while top pieces 19 (described more fully below) have recesses to snugly accommodate protrusions 31. Bottom piece 21 thus supports fingers F and top piece 19 while protrusions 31 serve to automatically align singers F and top pieces 19 with passages C as well as to maintain that alignment during usage of the apparatus.

The top piece 19 of guides D is shown in FIGS. 2 and 4. It has two functions: to guide misaligned bottles toward the center of passage C and to aid in securing fingers F and bars B. Top piece 19 has a flat bottom surface which is square and substantially the same size as bottom piece 21. It sides 20 are tapered toward the top so that piece 19 is pyramidal in shape. Each bottom corner has a recess 24 which can accommodate protrusion 31 of bottom piece 21. Top piece 19 fits snugly between protrusions 31 of bottom piece 21. Top piece 19 fits snugly between protrusions 31 and when properly seated is thereby prevented from turning. Since bottom piece 21 is aligned with passage E when properly mounted on bars B, top piece 19 is also aligned when it is positioned on piece 21. Thus, each tapered side 20 extends into a passage E and faces toward the center. As a misaligned bottle strikes and then slides down side 20 it is guided by it toward the center of passage E. Each side 20 of top piece 29 thus functions as a guide in its own right and piece 19 is therefore four guides joined together with each guide extending into one of those passages adjacent the position where piece 19 is mounted. A hole 26 runs through the center of top piece 19 and extends from the top to a narrower hole 28 which runs the remaining length of piece 19 through bottom portion 32. Hole 27 is wide enough to accommodate a screw 50 which serves as the fastening means for the assembly, as discussed below.

Pieces 19 and 21 of guide D can be made from any durable material. Plastic is preferred, however, because when such pieces are molded in quantity the cost is relatively low. Also, since the descending bottles do strike top piece 19, plastic will contribute to quieter operation. Furthermore, since plastic yields a bit on impact, bottle breakage is less likely than with, say, metal guides.

The particular construction of flexible fingers F shown in FIGS. 1, 2 and 4 is necessary to fulfill several requirements. First, fastening fingers F individually to bars B requires a significant portion of the total time required for assembly of the packing apparatus. Assembly time, and therefore labor costs, can be appreciably reduced by enabling several fingers to be fastened simultaneously to bars B. Second, fingers F must be readily mountable in a convenient manner to decrease labor time involved in replacing the fingers. Third, the fingers should be durable for long life and sufficiently resilient to adequately cushion the bottles.

Taking each of the above requirements in turn, two fingers 43 are joined to a common portion 41 to form a finger pair assembly 40. Therefore, the number of individual finger pieces that must be fastened to bars B is halved. Of course, the finger pair 40 is shown by way of example only and four fingers could be joined as well since, as discussed below, four adjacent fingers are fastened simultaneously at each mounting position along bars B. To more particularly describe an individual finger 43, it is bent at an angle to common portion 41 at 49. The bend at 49 is a smooth arc rather than a sharp angle. Finger 43 preferably is one width at portion 41, flares out at its central portion 45 and then narrows toward its end portion 46. The width at 41 is such as to fit snugly between protrusions 31 on bottom guide piece 21 while the width at end portion 46 is made such as to allow all four fingers in each passage E to extend to the center of the passage, as shown in FIG. 3, and thereby provide maximum cushioning effect. Central portion 45 is wider than the rest of finger 43 to provide added positioning control. It, as well as end portion 46, are concave so as to fit around the bottle. Therefore, the increased width adds to the surface area contacting the bottle, resulting in a more positive control. This increased width can, of course, be dispensed with for those applications not requiring such added control. The concavity in portions 45 and 46 has an additional advantage since it permits finger 43 to recede further into the corner of passage E, as shown by 43' in FIG. 4, when pushed there by bottle 48 as it is descending into the container and, thus, allows efficient utilization of container space.

To provide a mounting for fingers F which facilitates assembly of the apparatus, portion 41, which is common to both fingers 43 in a finger pair 40, serves as the mounting portion. It is flat, rectangular and has a hole 47 in its center. Its width is such as to fit snugly between protrusions 31 on bottom guide piece 21 and its length substantially coincides with that of top surface 35 of piece 21 so that arc 49 overlaps rounded edge 29 of surface 35. The arcs at 49 and 29 are designed to increase the life of finger 43 by spreading the bending stress at 49 over an area rather than having it concentrated at one vulnerable fulcrum point. Mounting of finger pair 40 is accomplished quickly and easily by simply placing mounting portion 41 on bottom guide piece 21 between protrusions 31 and a screw inserted through hole 47 secures it in place, as discussed below.

Fingers 43 can be made of any resilient material such as spring steel. Though spring steel provides satisfactory performance and is in conventional usage, plastic fingers are preferred for certain applications because they are quieter, more durable and less likely to scrape and scratch the bottles. Such plastic fingers up to the present time have required a spring steel backing because with the conventional, only slightly curved, fingers plastic alone is not sufficiently resilient to provide the necessary cushioning effect. However, my apparatus is particularly well suited for use of all-plastic fingers for those applications where such fingers are preferred. Thus, the advantages of the spring steel-backed plastic fingers are attained without the added cost of the spring steel. This advantage is due to the bend in the finger at 49. The bend at 49, which can be to an angle of about 80°, provides the necessary stress in the plastic to create enough resiliency for an adequate cushioning effect. The plastic material preferred is "Nylatron." It adds durability to the apparatus where it is most subject to wear, i.e. at the fingers, and its inherent lubricity increases the speed at which the articles descend into the container, allowing more articles to be packed within a given period of time. Furthermore, all-plastic fingers weigh less than fingers containing spring steel thereby adding this advantage to the others mentioned above.

In assembling the apparatus, each of bars 3–5 and 9 is secured to bars 7 by conventional means, such as brackets or by inserting a screw through a hole in bar 7 into a threaded hole in the end of bars 3–5 and 7. Grooves 27 of bottom guides piece 21 are aligned with a bar and piece 21 is lowered until boss 11 is fully inserted into hole 25 of piece 21 and top edge 13 of the bar contacts the top of groove 27. A finger pair 40 is then mounted on bottom piece 21 by placing mounting portion 41 on surface 35 so that it fits snugly between protrusions 31. Another finger pair 40 is then mounted on top of and perpendicular to the first pair 40 so that its mounting portion 41 also fits snugly between protrusions 31. In this position each finger 43 extends down and toward the center of passage E. Recesses 24 of top guide piece 19 are aligned with protrusions 31 and piece 19 is placed on top of upper finger pair 40. Protrusions 31 fit snugly into recesses 24 and prevent any movement of piece 19 except in the vertical direction. It is now easy to see the reason for tapering sides 37 of protrusion 31. Were these sides made perpendicular to surface 35 of piece 21, an edge of protrusion 31 would extend beyond tapered side 20 of the piece 21 and would be struck by descending bottles, possibly causing breakage. Finally, a screw is inserted into the aligned holes of guide D and finger pairs 40 and screwed into threaded hole 12 in boss 11. By tightening screw 50 against bottom section 32 in piece 19 all the parts are securely and immovably fastened to the bar. Assembly and replacement of four fingers and four guides is thus easily and quickly completed by the mere fastening of a single screw.

In operation, the apparatus is positioned below the packing station and when the container is in its proper position in relation to the packing station the bottles are released to fall into the container. As each bottle descends, if it is misaligned with passage E it will strike a guide D. As it slides down guide D it is pushed toward the center of the passage. If it is still slightly misaligned after its bottom has descended beyond guide D it will strike notch 15 in bars B. Beyond this point fingers F will further center it within the passage as they spread while simultaneously cushioning the impact.

Figure 7:
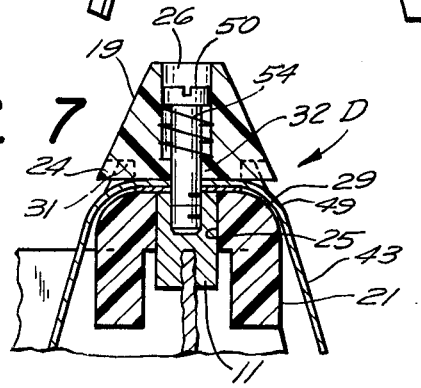
FIG. 7 is a sectional view, similar to FIG. 4, of a second embodiment providing adjustable resiliency of the flexible fingers.

Many different types of bottles are usually packed at every plant. If the bottles differ considerably in size then a different packing grid must be used for each since the size of the passages might be too large or too small. However, if the size is similar and the bottles differ only by weight then the same grid could be used except for the fact that heavier bottles require more of a cushioning effect to prevent breakage as they impact on the container. Since flexible fingers have a present tension providing a predetermined cushioning effect, the same fingers cannot be used to cushion heavier bottles. Consequently, either a new grid with different fingers must be used or all the fingers in the grid must be replaced. The cost of maintaining several grids or of replacing the fingers is such as to make provision of fingers with an adjustable cushioning effect highly desirable since the same grid and the same fingers can be used for various weights of bottles. FIG. 7 shows an embodiment enabling such an adjustable cushioning effect with the packing framework of the invention. It is achieved with the addition of only a single spring 54 to the parts in the embodiment of FIGS. 1-6. The parts are assembled precisely as disclosed above except that the spring is fastened between bottom section 32 of top guide part 19 and the head of screw 50. As each finger is moved aside by the descending bottle it will have a tendency to force mounting section 41 upward because of the fulcrum effect at edge 29. The degree of freedom allowed section 41 affects the force required to bend the finger and, therefor, the cushioning effect. Therefore, the maximum cushioning effect is provided by the first embodiment, as best shown in FIG. 4, wherein the screw is tightened against portion 32 of top guide piece 19 thereby immovably pressing mounting section 41 between the flat surfaces of pieces 19 and 21. However, use of spring 54 allows mounting portion 41 and piece 19 some movement depending on the downward force exerted by the spring on section 32. This force is adjustable by the screw 54. Clearly if the screw is tightened the force exerted by the spring is increased whereas loosening of the screw will allow freer movement of the mounting section. Adjustability of the cushioning effect is thus provided simply and cheaply and can be effected by the mere turning of a screw.

It will be apparent from the foregoing that the advantages of the present invention are achieved by utilizing a minimum number of bars in combination with parts serving the dual purpose of defining the passages and guiding articles into alignment with the passages. Also, all the parts of the apparatus are designed to fit together so that no manual alignment for each individual passage E is necessary thereby increasing the speed and ease of assembly. Furthermore, adjustment of the cushioning effect is provided with the addition of only one inexpensive part. In addition, the structure is such as to permit ready utilization of plastic parts for a durable, lightweight, inexpensive, and quiet apparatus.

While but two embodiments of the present invention have been here specifically disclosed, it will be apparent that many variations may be made therein, all within the scope of the instant invention as defined in the following claims.

I claim:

1. In an apparatus for guiding and cushioning a plurality of articles adapted to be deposited into a container positioned below said apparatus, the combination comprising:

a. a support;

b. a plurality of elongated members mounted on said support spaced from one another to define therebetween a plurality of unobstructed elongated spaces open at top and bottom with each space bounded on its sides by adjacent ones of said members;

c. guides mounted on and exposed at the upper portions of said members at intervals spaced along said members and having portions overhanging said members and extending over said spaces to define a row of vertical passages subdividing said elongated spaces with each of said passages being bounded in part by two of said members and in part by said guides, each of said articles being adapted to be deposited into a container through one of said passages;

d. flexible fingers secured to said members and extending inwardly of said passages, adjacent fingers of adjacent passages being connected to one another to define a unit having a mounting section adapted to be secured to an associated member, from which mounting section said fingers extend inwardly of said adjacent passages; and e. means for fastening said finger mounting section between a guide and said associated member;

whereby as the article approaches the apparatus it is initially moved into proper position in said passage by said guide and then further guided by said flexible fingers so that it is deposited into the container.

2. The apparatus of claim 1 wherein the said passages are adjacent only at corners thereof, said mounting section of said unit extending substantially from one of said corners to the other.

3. The apparatus of claim 2, in which each one of said guides is located on its associated member so as to define, at least in part, a corner of one of said passages.

4. The apparatus of claim 3, in which a plurality of said guides are located adjacent one another to define corner portions of adjacent passages.

5. The apparatus of claim 4, in which said plurality of guides defining corner portions of adjacent passages are integral with one another.

6. The apparatus of claim 1, in which a plurality of guides defining adjacent portions of adjacent passages are integral with one another.

7. The apparatus of claim 1, wherein said overhanging guide portions are aligned with said fingers and configured and dimensioned to guide impinging articles onto said fingers.

8. The apparatus of claim 1 wherein said fastening means secure said guides to their associated members and cause said guides to operatively engage said mounting sections to hold said mounting sections in place.

9. The apparatus of claim 8 wherein said fastening means further causes said guides to resist upward deflection of said mounting sections.

10. The apparatus of claim 8 wherein said fastening means pass through said finger mounting sections.

11. In an apparatus for guiding and cushioning aplurality of articles adapted to be deposited into a container positioned below said apparatus, the combination comprising:

a. a support;

b. a plurality of elongated members mounted on said support spaced from one another to define therebetween a plurality of spaces open at top and bottom with each space bounded on its sides by adjacent ones of said members;

c. guides mounted on and exposed at the upper portions of said members at intervals spaced along said members and having portions overhanging said members and extending over said spaces to define a row of veritcal passages with each of said passages being bounded in part by two of said members and in part by said guides, each of said articles being adapted to be deposited into a container through one of said passages;

d. flexible fingers secured to said members with adjacent fingers of adjacent passages being connected to one another to define a unit having a mounting section adapted to be secured to an associated member, from which mounting section said fingers extend inwardly of said passages, whereby as the article approaches the apparatus it is initially moved into proper position in said passage by said guides and then further guided by said flexible fingers so that it is deposited into the container; and e. means for fastening at least one of said finger mounting sections between a guide and said associated member.

12. The apparatus of claim 11, wherein the said adjacent passages are adjacent only at corners thereof, said mounting section of said unit extending from one of said corners to the other.

13. The apparatus of claim 12, in which each one of said guides is located on its associated member so as to define, at least in part, a corner of one of said passages.

14. The apparatus of claim 11, wherein said overhanging guide portions are aligned with said fingers and configured and dimensioned to guide impinging articles onto said fingers.

15. The apparatus of claim 11 wherein said fastening means secure said guides to their associated members and cause said guides to operatively engage said mounting sections to hold said mounting sections in place.

16. The apparatus of claim 15 wherein said fastening means further causes said guides to resist upward deflection of said mounting sections.

17. The apparatus of claim 15 wherein said fastening means further causes said guides to resist upward deflection of said mounting sections.

18. In an apparatus for guiding and cushioning a plurality of articles adapted to be deposited into a container positioned below said apparatus, the combination comprising:

a. a support;

b. a plurality of elongated members mounted on said support spaced from one another to define therebetween a plurality of spaces open at top and bottom with each space bounded on its sides by adjacent ones of said members;

c. guides mounted on and exposed at the upper portions of said members at intervals spaced along said members and having portions overhanging said members and extending over said spaces to define a row of vertical passages with each one of said passages being bounded in part by two of said members and in part by said guides, a plurality of said guides defining adjacent portions of adjacent passages being integral with one another, each of said articles being adapted to be deposited into a container through one of said passages; and d. flexible fingers secured to said members and extending inwardly of said passages, whereby as the article approaches the apparatus it is initially moved into proper position in said passage by said guides and then further guided by said flexible fingers so that it is deposited into the container, each one of said flexible fingers having a mounting section with at least one of said finger mounting sections being fastened between a plurality of guides defining corner portions of adjacent passages and a member associated with said plurality of guides.

19. The apparatus of claim 18, in which said guides define, at least in part, corner portins of said passages.

20. The apparatus of claim 19, in which a plurality of said guides are located adjacent one another to define corner portions of adjacent passages.

21. The apparatus of claim 20, in which said plurality of guides defining corner portions of adjacent passages are integral with one another.

22. The apparatus of claim 18, wherein said overhanging guide portions are aligned with said fingers and configured and dimensioned to guide impinging articles onto said fingers.

23. The apparatus of claim 18 additionally including means to fasten said plurality of guides defining cover portions of adjacent passages to said associated member and cause them to operatively engage said mounting sections to hold said mounting sections in place.

24. The apparatus of claim 23 wherein said fastening means further causes said plurality of guides defining cover portions of adjacent passages to resist vertical deflection of said mounting sections.

25. The apparatus of claim 23 wherein said fastening means pass through said finger mounting sections.

26. In an apparatus for guiding and cushioning a plurality of articles adapted to be deposited into a container positioned below said apparatus, the combination comprising:

a. a plurality of spaced, elongated members having bosses extending upwardly therefrom;

b. means to secure said members in a framework defining vertical passages bounded at least in part by said members, with each of said articles being adapted to be deposited into the container through one of said passages;

c. guide mounting pieces securely fitted on the upper portion of said members at intervals therealong to define at least in part corners of said passages and having recesses adapted to receive said bosses as said guide mounting pieces are positioned onto said members;

d. tapered guides positioned atop said guide mounting pieces to define, at least in part, corners of said passages and having their tapered portions facing upwardly;

d. fastening means; and f. flexible fingers having finger mounting sections secured by said fastening means between a tapered guide and its associated guide mounting piece so that each one of said fingers extends inwardly of a passage, said guide mounting pieces, said tapered guides, and said finger mounting sections each having holes, therein, said bosses having threaded holes therein, and said fastening means comprising a screw inserted through said holes and into said threaded hole;

whereby as the article approaches the apparatus it is initially moved into proper position in said passages by said tapered guides and further guided by said flexible fingers so that it is deposited into the container.

27. The apparatus of claim 26, wherein said tapered guides have a portion overhanging said members to define passages bounded in part by two of said members and in part by said guides.

28. The apparatus of claim 27, wherein said passages are adjacent at corners thereof, and guides positioned at adjacent corners are integral with one another to form a unit.

29. The apparatus of claim 27, wherein said overhanging guide portions are aligned with said fingers and configured and dimensioned to guide impinging articles onto said fingers.

30. The apparatus of claim 28, wherein said guide unit has a pyramidal shape.

31. The apparatus of claim 30, wherein said overhanging portions of said guides are comprised of adjacent faces of said pyramidal shape unit and are aligned with said fingers.

32. The apparatus of claim 26, wherein a portion of said tapered guide securely engages a portion of said guide mounting piece.

33. The apparatus of claim 26 further comprising a spring secured to said tapered guide by said screw whereby bias on the spring can be adjusted by turning the screw, thereby varying the cushioning effect of said fingers.

34. The apparatus of claim 26, wherein said guide mounting pieces have grooves extending from said recesses to the edges of said guide mounting pieces, said members fitting into said grooves as said bosses fit within said recesses.

35. In an apparatus for guiding and cushioning a plurality of articles deposited into a container positioned below said apparatus, which apparatus includes a framework of elongated members secured together to at least in part defein passages, said articles being adapted to be deposited into said container through said passages, flexible fingers fastened at intervals along the periphery of each of said passages and extending inwardly of said passages, the improvement comprising:

a. said fingers having a mounting portion extending from the finger proper and placed atop one said members, and b. resilient means resiliently securing said mounting portion to said one member and allowing vertical movement of said mounting portion relative to said one member, whereby the cushioning effect of said flexible fingers which move their respective mounting portions as said fingers are separated by the articles as they pass through said passages is dependent on the amount of the movement of said mounting portions allowed by said resilient means.

36. The apparatus of claim 35, wherein said passages have corners wherein said fingers are fastened at said corners.

37. The apparatus of claim 36, wherein adjacently mounted fingers are fastened at their respective mounting portions by a common resilient means.

38. The apparatus of claim 36, wherein adjacent fingers of passages adjacent only at their corners are connected to one another by a common mounting portion.

39. The apparatus of claim 35, wherein said resilient means is adjustable.

40. In an apparatus for guiding and cushioning a plurality of articles deposited into a container positioned below said apparatus, which apparatus includes a framework of elongated members secured together to at least in part define passages, said articles being adapted to be deposited into said container through said passages, flexible fingers fastened at intervals along the periphery of each of said passages and extending inwardly of said passages, the improvement comprising:

a. said fingers having a mounting portion extending from the finger proper and placed atop one said members, and b. resilient means resiliently securing said mounting portion to said one member and allowing movement of said mounting portion relative to said one member, said resilient means comprising a spring and an adjustable element, said spring being compressed between said adjustable element and said finger mounting portion, whereby the cushioning effect of said flexible fingers which move their respective mounting portions as said fingers are separated by the articles as they pass through said passages is dependent on the amount of the movement of said mounting portions allowed by said resilient means.

41. In an apparatus for guiding and cushioning a plurality of articles adapted to be deposited into a container positioned below said apparatus, the combination comprising:

a. a support;

b. a plurality of elongated members mounted on said support spaced from one another to define therebetween a plurality of unobstructed elongated spaces open at top and bottom with each space bounded on its sides by adjacent ones of said members;

c. guides mounted on and exposed at the upper portions of said members at intervals spaced along said members and having portions overhanging said members and extending over said spaces to define a row of vertical passages subdividing said elongated spaces with each of said passages being bounded in part by two of said members and in part by said guides, each of said articles being adapted to be deposited into a container through one of said passages;

d. flexible fingers secured to said members and extending inwardly of said passages, whereby as the article approaches the apparatus it is initially moved into proper position in said passage by said guide and then further guided by said flexible fingers so that it is deposited into the container; and e. an element adjustably mounted on at least one of said guides and a spring operatively disposed intermediate a portion of said adjustable element and at least one of said fingers, said spring being compressed between said adjustable element and at least one of said fingers to effect an adjustable cushioning effect of said at least one finger.

42. In an apparatus for guiding and cushioning a plurality of articles adapted to be deposited into a container positioned below said apparatus, the combination comprising:

a. a support;

b. a plurality of elongated members mounted on said support spaced from one another to define therebetween a plurality of spaces open at top and bottom with each space bounded on its sides by adjacent ones of said members;

c. guides mounted on and exposed at the upper portions of said members at intervals spaced along said members and having portions overhanging said members and extending over said spaces to define a row of vertical passages with each of said passages being bounded in part by two of said members and in part by said guides, each of said articles being adapted to be deposited into a container through one of said passages;

d. flexible fingers secured to said member with adjacent fingers of adjacent passages being connected to one another to define a unit having a mounting section adapted to be secured to a member from which mounting section said fingers extend inwardly of said passages, whereby as the article approaches the approaches the apparatus it is initially moved into proper position in said passage by said guides and then further guided by said flexible fingers so that it is deposited into the container; and e. an element adjustably mounted on at least one of said guides and a spring operatively disposed intermediate a portion of said adjustable element and at least one of said fingers, said spring being compressed between said adjustable element and said mounting section to effect an adjustable cushioning effect of said at least one finger.

43. In an apparatus for guiding and cushioning a plurality of articles adapted to be deposited into a container positioned below said apparatus, the combination comprising;

a. a support;

b. a plurality of elongated members mounted on said support spaced from one another to define therebetween a plurality of spaces open at top and bottom with each space bounded on its sides by adjacent one of said members;

c. guides mounted on and exposed at the upper portions of said members at intervals spaced along said members and having portions overhanging said members and extending over said spaces to define a row of vertical passages with each one of said passages being bounded in part by two of said members and in part by said guides, a plurality of said guides defining adjacent portions of adjacent passages being integral with one another, each of said articles being adapted to be deposited into a container through one of said passages;

d. flexible fingers secured to said members and extending inwardly of said passages, whereby as the article approaches the apparatus it is initially moved into proper position in said passage by said guides and then further guided by said flexible fingers so that it is deposited into the container; and e. an element adjustably mounted on at least one of said guides and a spring operatively disposed intermediate a portion of said adjustable element and at least one of said fingers, said spring being compressed between said adjustable element and at least one of said fingers to effect an adjustable cushioning effect of said at least one finger.

44. In an apparatus for guiding and cushioning a plurality of articles adapted to be deposited into a container positioned below said apparatus, the combination comprising:

a. a plurality of spaced, elongated members, b. means to secure said members in a framework defining vertical passages bounded at least in part by said members, with each of said articles being adapted to be deposited into the container through one of said passages, c. tapered guides positioned atop and at intervals along said members to define, at least in part, corners of said passages and having their tapered portions facing upwardly, d. adjustable fastening means, e. flexible fingers secured by said adjustable fastening means between a tapered guide and its associated member so that each one of said fingers extends inwardly of a passage, whereby as the article approaches the apparatus it is initially moved into proper position in said passages by said tapered guides and further guided by said flexible fingers so that it is deposited into the container, and f. a spring compressed between a portion of said adjustable fastening means and a portion of said tapered guide to effect an adjustable cushioning effect of said fingers.

45. In an apparatus for guiding and cushioning a plurality of articles adapted to be deposited into a container positioned below said apparatus, the combination comprising:

a. a plurality of spaced, elongated members having bosses extending upwardly therefrom;

b. means to secure said members in a framework defining vertical passages bounded at least in part by said members, with each of said articles being adapted to be deposited into the container through one of said passages;

c. guide mounting pieces securely fitted on the upper portion of said members at intervals therealong to define at least in part corners of said passages and having recesses adapted to receive said bosses as said guide mounting pieces are positioned onto said members and grooves extending from said recesses to the edges of said guide mounting pieces adapted to receive said members as said bosses fit within said recesses;

d. tapered guides positioned atop said guide means mounting pieces to define, at least in part, corners of said passages and having their tapered portions facing upwardly;

e. fastening means; and f. flexible fingers having finger mounting sections secured by said fastening means between a tapered guide and its associated guide mounting piece so that each one of said fingers extends inwardly of a passage, whereby as the article approaches the apparatus it is initially moved into proper position in said passages by said tapered guides and further guided by said flexible fingers so that it is deposited into the container.

* * * * *